US006913258B2

(12) United States Patent
Hung

(10) Patent No.: US 6,913,258 B2
(45) Date of Patent: Jul. 5, 2005

(54) INDICATION STRUCTURE FOR PAPER RESERVES ADAPTED FOR AUTO DOCUMENT FEED APPARATUS

(75) Inventor: Ming-Te Hung, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 10/613,046

(22) Filed: Jul. 7, 2003

(65) Prior Publication Data

US 2005/0017435 A1 Jan. 27, 2005

(51) Int. Cl.[7] ..... B65H 1/00
(52) U.S. Cl. ..... 271/145; 271/147
(58) Field of Search ..... 271/145, 147; 221/6

(56) References Cited

U.S. PATENT DOCUMENTS 3,260,402 A * 7/1966 Lareau et al. ..... 221/4
5,053,814 A * 10/1991 Takano et al. ..... 399/23
5,236,348 A * 8/1993 Fetherolf et al. ..... 400/703
5,273,271 A * 12/1993 Intemann ..... 271/145
5,700,003 A * 12/1997 Sung ..... 271/110

* cited by examiner

*Primary Examiner*—David H. Bollinger
(74) *Attorney, Agent, or Firm*—Birch, Stewart, Kolasch & Birch, LLP

(57) ABSTRACT

An indication structure for paper reserves adapted for auto document feed apparatus includes a housing, a delivered module, a support element, an elasticity element, an indication element and a transparent element; wherein, the indication element includes a transmission roller, an indication roller and belt, for transmission or indication, the transparent element on which an opening of the housing is mounted. Whereby, using the simplest structure to improve higher manufactured cost, process and longer time of fabrication for the conventional indication structure of paper reserves.

18 Claims, 4 Drawing Sheets

INDICATION STRUCTURE FOR PAPER RESERVES ADAPTED FOR AUTO DOCUMENT FEED APPARATUS

BACKGROUND OF THE INVENTION

1. Field of the Invention

The present invention relates to an indication structure for paper reserves, and in particular to an indication structure for paper reserves for use in an auto document feed apparatus that can provide an indication of paper reserves.

2. Description of the Prior Art

Following the upgraded rapidly of the industry, and the times of knowledge economic coming, such that the people use paper, files and messages in writing, which dealing with each other is more frequently; each type of the printers, copy writers, fax machines or auto document feed apparatuses has been the major product for modern. Therefore, high added value, high resolution, light, cost cheap and fabrication convenience has been a major index for choosing.

Reference is made to FIG. 1, which illustrates an indication structure for paper reserves. The indication structure is adapted for use in accord with the prior art printers, copiers, fax machines or auto document feed apparatuses. The indication structure for paper reserves has a support plate 11*a* for receiving paper. Support plate 11*a* contacts a spring 12*a*. The bottom of the support plate 11*a* has a hook 13*a*. The indication structure for paper reserves has a cord 1*a* and cord 1*a* has a first end and a second end, of which the first end links to the hook 13*a*. A support shaft 2*a* connects to a housing 14*a* of the auto document feed apparatus to allow the cord 1*a* to slide thereon. A slide 3*a* links to the second end of the cord 1*a* and slide 3*a* has a paper reserves indication pin 31*a* thereon to indicate the paper reserves. A guide shaft 4*a* is vertically arranged on the housing 14*a* of the auto document feed apparatus to allow the slide 3*a* to slide thereon. Support plate 11*a* compresses spring 12*a* and influences cord 1*a* to make slide 3*a* slide, on the guide shaft 4*a* when the paper-reserves in the support plate 11*a* of the auto document feed apparatus are high. As paper reserves decrease, the support plate 11*a* moves gradually upward due to a force of the spring 3*a*, thereby causing the paper reserves indication pin 31*a* to indicate the amount of paper reserves.

Reference is made to FIG. 2, in which another indication structure for paper reserves adapted for auto document feed apparatus is illustrated in accord with the prior art. The indication structure for paper reserves has a support plate 1*a'* for receiving paper and a lead screw 2*a'* contacts the bottom of the support plate 1*a'* to provide the support plate 1*a'* for displacement upward or downward. A drive motor 3*a'* is located on a side of the lead screw 2*a'*, the drive motor has at least one gear, to provide the, lead screw 2*a'* rotationally contacted therewith. A sensor 4*a'* is located on a top side of the support plate 1*a'* to provide pressure measurement. A feedback signal control module for drive motor 5*a'* contacts the drive motor 3*a'* or the sensor 4*a'* electrically. Thereby, a program design of the feedback signal control module for drive motor 5*a'* controls, while the paper do not reach the prediction high of paper, then paper do not touch the pressure sensor 4*a'*, at the same time the sensor 4*a'* provides an electrical signal for the feedback signal control module for drive motor 5*a'*, (which is) dealt by the program design of the feedback signal control module for drive motor 5*a'*, to output a electrical signal to the drive motor 3*a'* which driven the lead screw 2*a'* to generate a displacement upward, making the paper arranges on the support plate 1*a'* to reach and touch the pressure sensor 4*a'*, so that using the sensor 4*a'* to detect the variation of the paper reserves, providing a electrical signal for the feedback signal control module for drive motor 5*a'*, dealt by the program design of the feedback signal control module for drive motor 5*a'*, to output a prediction known ideal value signal to the drive motor 3*a'*, thereby, to reach the purpose of automatic detecting paper reserves.

Moreover, the taught indication structure for paper reserves adapted for auto document feed apparatus as above description, (which is) providing a function of the paper reserves for showing or detecting, however, due to some manufacture technology limitations, more work pieces cause to be restricted of manufactured cost and fabrication on production line, and the mechanical complexity increases, too. Thereof, (it is) the qualities of taught manufacture technology limitations, such that the indication structure for paper reserves adapted for auto document feed apparatus can not be easily fabricated and fast maintained, thus the manufactured cost will be also increased.

Following the upgraded rapidly of the industry, such that the life of humans is also changed; fast, convenient, easy, light, handy and cheap is a code word of the modern. However, the taught indication structure for paper reserves adapted for auto document feed apparatus is unfavorable to repair, replace and maintain. Simultaneously, the manufactured cost and the difficulty of fabrication are increased, too. Today the requirements of indication structure for paper reserves adapted for auto document feed apparatus known in the prior art could not be reached.

Further, in according to the Kennedy's theorem or the Grashof's theorem of the Mechanical Engineering, we know that a multi-bar linkage system (generally above four-bar linkage) often has a plurality of instantaneous center or multi-degree of freedom thereon. Consequently, requires the higher precision for fabricating or arranging the mechanical system, the manufactured cost and the difficulty of fabrication increases, too.

Accordingly, as above description we knowing the indication structure for paper reserves adapted for auto document feed apparatus known in the prior art having exists a non-convenience and defect in using practically.

Therefore, the present invention is directed to an improved the indication structure for paper reserves adapted for auto document feed apparatus with the inventor's research hardly and the application of theorem having a reasonable design and lower manufactured cost thereon.

SUMMARY OF THE DISCLOSURE

It is an object of the present invention to provide an indication structure for paper reserves adapted for auto document feed apparatus, for achieving the function of indicating paper reserves with more simplistic, and further corresponds to the micro scale trend, thereby decreasing the cost of fabrication and manufacture.

In order to achieve the above objective of the invention that providing an indication structure for paper reserves adapted for an auto document feed apparatus has a housing, at least one opening is arranged thereon, a support element is received in the housing, an elasticity element fixedly is positioned between the housing and the support element, to contact with the support element elastically, a delivered module is received in the housing, to convey or deliver paper; the indication structure for paper reserves is comprising: an indication element having a transmission roller pivotally connected with the housing, an indication roller is arranged on a side of the transmission roller and pivotally connected with the housing; a belt, is fixedly contacted with the transmission roller and the indication roller, for providing a transmission or an indication.

In the cause of examiner or judge can further knowing in other objects, feathers and technological subject matters of the invention will be apparent from the following detailed description taken in connection with the accompanying drawings. However, the present examples and embodiments are to be considered in all respects as illustrative and not restrictive, and the invention is not to be limited to the details given herein.

BRIEF DESCRIPTIONS OF THE DRAWINGS

The present invention can be fully understood from the following detailed description and preferred embodiment with reference, to the accompanying drawings in which.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating-general principles of embodiments of the invention. The scope of the invention is best defined by the appended claims.

Although the embodiments of the present invention are described below in connection with an indication structure for paper reserves adapted for auto document feed apparatus, the present invention can be applied to all auto document feed apparatus, including but not limited to auto document feed devices, printers, copy writers, fax machines, as well as all other auto document feed apparatus and feed paper machines.

Figure 1:
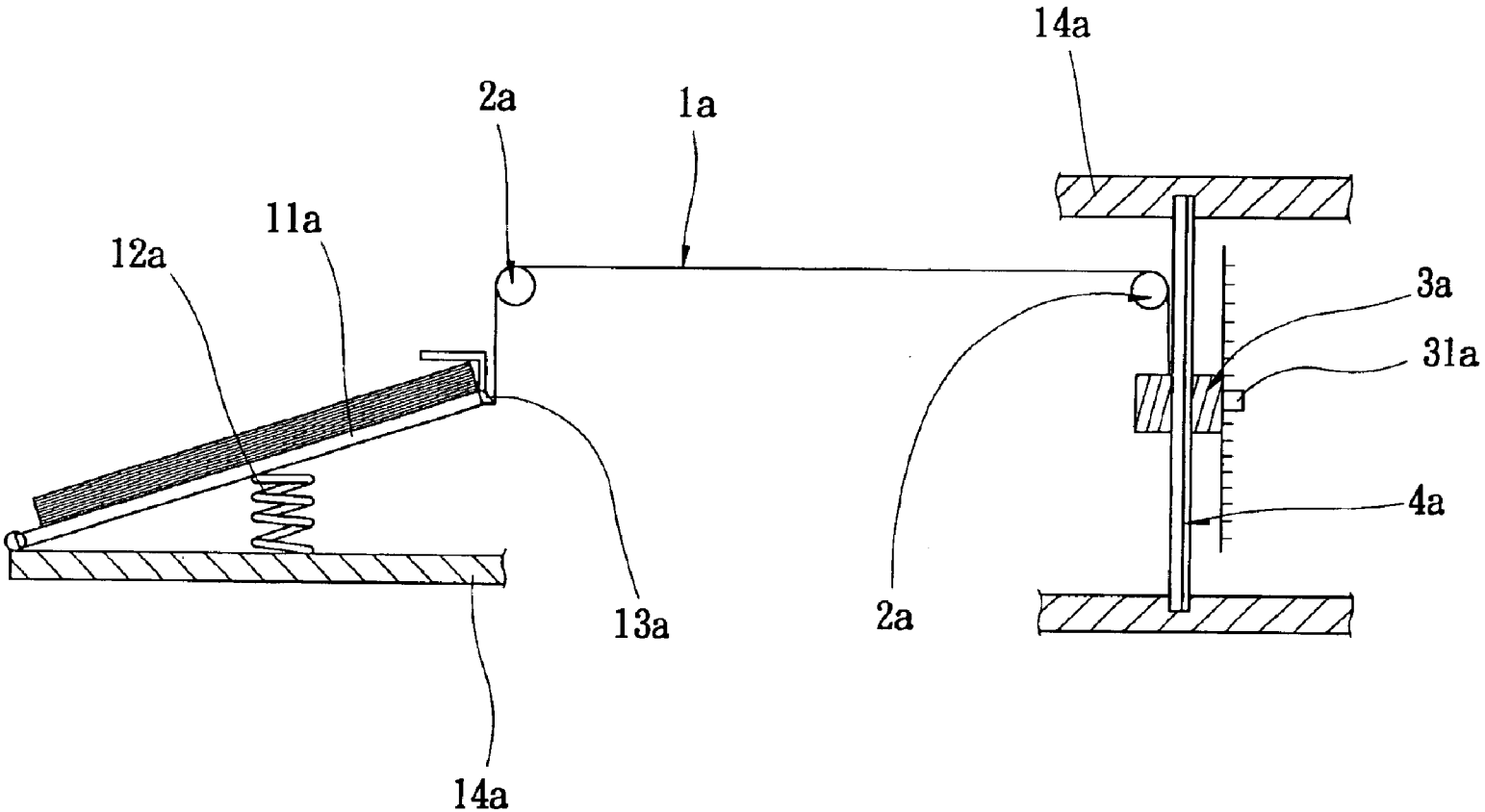
FIG. 1 PRIOR ART
FIG. 1 is a perspective view of a conventional indication structure for paper reserves adapted for auto document feed apparatus.
Figure 2:
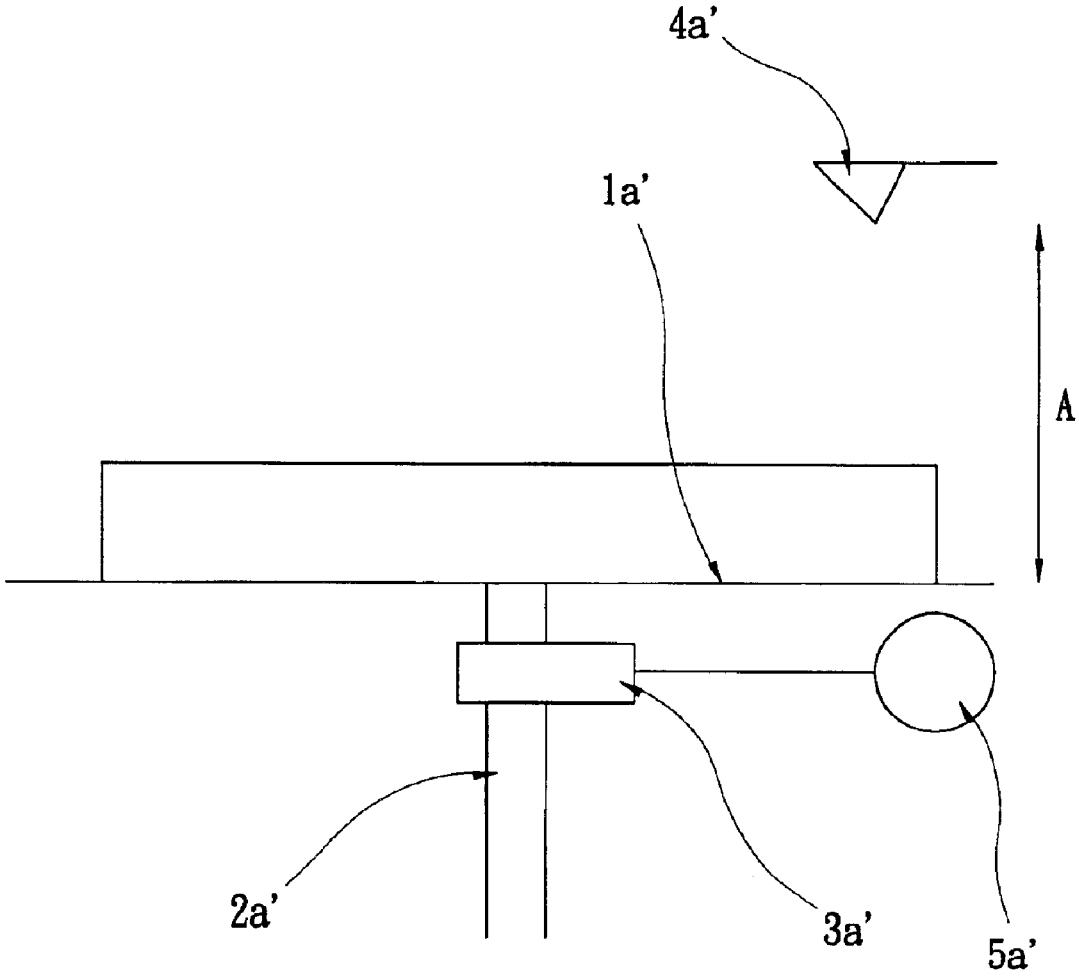
FIG. 2 PRIOR ART
FIG. 2 is a perspective view of another conventional indication structure for paper reserves adapted for auto document feed apparatus.
Figure 3:
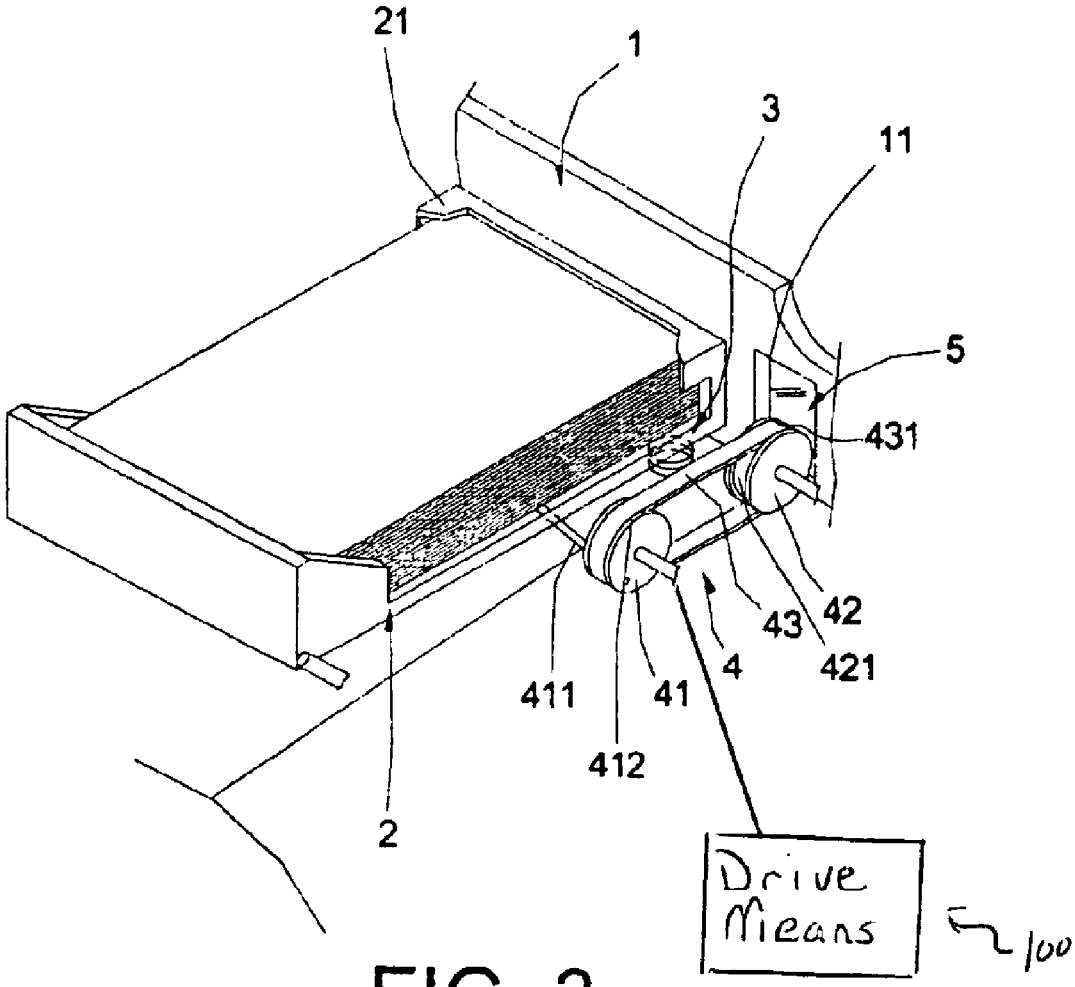
FIG. 3 is a perspective view according to an embodiment of the present invention.

Please refer to FIG. 3 illustrates an indication structure for paper reserves adapted for auto document feed apparatus, wherein the auto document feed apparatus has a housing 1, at least one opening 11 is arranged thereon, a support element 2 is received in the housing 1, for receiving paper therein, a side of the support element 2 pivotally connects to the housing 1, for providing the support element 2 vibration on the pivotal portion; an elasticity element 3 is a spring or a spring band fixedly positioned between the housing 1 and the support element 2, to contact with the support element 2 elastically, which is providing a suitable elasticity for the support element 2; a hamper 21 protrudes from the top side of support element 2, to withstand the paper on the support element 2, for providing a reaction force, which is equal to an elasticity force generated by the spring 3. A delivered module (not shown) is received in the housing 1, to convey or deliver paper; a printer module (not shown) is arranged on the paper output of the delivered module for printing.

The indication structure can be adjacent to the opening 11 for paper reserves and includes an indication element 4 further having a transmission roller 41, an indication roller 42, a belt 43, and a drive means 100. A central pivotal shaft of the transmission roller 41 pivotally connects with the housing 1, and the transmission roller 41 has a protrusion portion 411, which extends from a side surface of the transmission roller 41 and contacts with the support element 2, thereby, the protrusion portion 411 is not located at the same axis with the central pivotal shaft of the transmission roller 41, 50 that a moment force can be generated, to provide an angular displacement with the transmission roller 41 while the support element 2 has a displacement with the paper reserves variation. A circumferential surface of the transmission roller 41 has a groove 412 thereon; a circumferential surface of the indication roller 42 also has a groove 421, and the indication roller 42 is arranged on a side of the transmission roller 41 or pivotally connected with the housing 1. The belt 43 has at least one smooth surface thereon, fixedly contacted with the transmission roller and the indication roller, for providing a transmission therebetween. A side of the belt 43 has an indication mark 431 for indication. A transparent element 5 is a piece of optical transparent plastic or optical glass, mounted on the opening 11 of the housing 1, further including a measure line or a notch thereon, whereby, it is convenient for a user to observe directly and exactly to know the paper reserves of the auto document feed apparatus from outside while in use.

Figure 4:
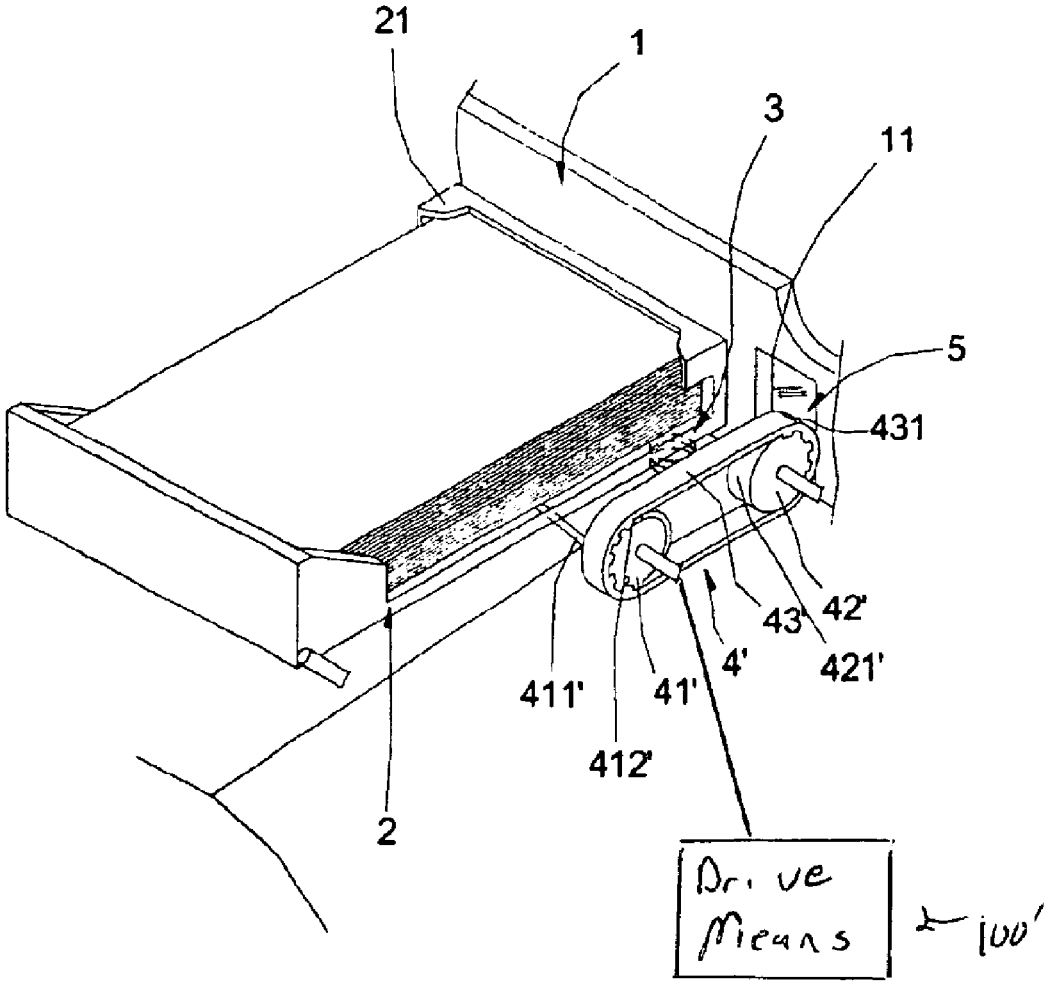
FIG. 4 is a perspective view according to another embodiment of the present invention.

Please refer to FIG. 4 illustrates another indication structure for paper reserves adapted for auto document feed apparatus, wherein the indication structure for paper reserves includes an indication element 4' further having a transmission roller 41', an indication roller 42', and a belt 43', and a drive means 100'. A central pivotal shaft of the transmission roller 41' pivotally connects with the housing 1, and the transmission roller 41' has a protrusion portion 411', which extends from a side surface of the transmission roller 41' and contacts with the support element 2, thereby, the protrusion portion 411' is not located at the same axis with the central pivotal shaft of the transmission roller 41', so that a moment force can be generated, to provide a angular displacement with the transmission roller 41' while the support element 2 has a displacement with the paper reserves variation. A circumferential surface of the transmission roller 41' has a plurality of teeth portion 412' thereon; a circumferential surface of the indication roller 42' also has a plurality of teeth portions 421', and the indication roller 42' is arranged on a side of the transmission roller 41' or is pivotally connected with the housing 1. The belt 43' has a plurality of teeth portions thereon, fixedly contacted with the transmission roller 41' and the indication roller 42', for providing a transmission therebetween. A side of the belt 43' has an indication mark for indication. A transparent element 5 is a piece of optical transparent plastic or optical glass, mounted on the opening 11 of the housing 1, further including a measure line or a notch thereon, whereby, it is convenience for user to observe directly and exactly to know the paper reserves of the auto document feed apparatus form outside while use.

A prototype of indication structure for paper reserves adapted for auto document feed apparatus has been constructed herein with feathers as above descriptions, the present invention is using the most simplistic mechanical structure, decreasing the manufactured cost and time of fabrication substantially, to increase the convenience for using, fabrication and repair. Simultaneously, the present invention eliminates and saves more mechanical structures or elements than the conventional multi-bar linkage mechanical apparatus and obtains the equality function or even better, and saves more space. So that the present invention improves the defect of the known indication structure for paper reserves adapted for auto document feed apparatus in prior art that cannot effectively decrease higher manufactured cost and longer time of fabrication and maintainability, moreover, the present invention also reduces the volume of the indication structure for paper reserves to correspond with the fashion of modern.

Although particular embodiment of the invention has been described in detail for purpose of illustration, various modifications and enhancements maybe made without departing from the spirit and scope of the invention. Accordingly, the invention is not to be limited except as by the appended claims.

What is claimed is:

1. An indication structure for paper reserves adapted to an auto document feed apparatus having a housing, at least one opening arranged thereon, a support element received in the housing, an elasticity element fixedly positioned between the housing and the support element for contacting with the support element elastically; and the indication structure comprising:

an indication element having a transmission roller connected with the housing, an indication roller and a belt with which the transmission roller and the indication roller are engaged wherein the transmission roller is driven by a driving means and the support element is movable up and down due to the paper reserves;

whereby the paper reserves are indicated through an indication mark on the belt which is movable by the transmission roller and the indication roller.

2. The indication structure as claimed in claim 1, wherein the belt has an outside on which the indication mark is positioned adjacent to the opening for indication, and the belt has an inside defining a smooth surface or a plurality of teeth portions to engage with the transmission roller and the indication roller.

3. The indication structure as claimed in claim 2, wherein the transmission roller comprises a groove arranged on a curved surface thereof for the corresponding smooth surface of the belt matching within the groove of the transmission roller.

4. The indication structure as claimed in claim 2, wherein the indication roller comprises a groove arranged on a curved surface thereof for the corresponding smooth surface of the belt matching within the groove of the indication roller.

5. The indication structure as claimed in claim 2, wherein the transmission roller comprises a plurality of teeth portions arranged on a curved surface thereof, for the corresponding teeth portions of the belt engaging with the teeth portions of the transmission roller.

6. The indication structure as claimed in claim 2, wherein the indication roller comprises a plurality of teeth portions arranged on a curved surface thereof for the corresponding teeth portions of the belt engaging with the teeth portions of the indication.

7. The indication structure as claimed in claim 1, wherein the transmission roller further comprises a protrusion portion arranged on a non-curved surface thereof, for contacting with the support element.

8. The indication structure as claimed in claim 1, further comprising a transparent element mounted in the at the least one opening.

9. The indication structure as claimed in claim 8, wherein the transparent element is a piece of optical transparent plastic or optical glass.

10. An indication structure comprising:

an indication element having a transmission roller, an indication roller and a belt with which the transmission roller and the indication roller are engaged wherein the transmission roller is driven by a driving means and the support element is movable up and down due to the paper reserves;

whereby the paper reserves are indicated through an indication mark on the belt which is movable by the transmission roller and the indication roller.

11. The indication structure as claimed in claim 10, wherein the belt has an outside on which the indication mark is positioned adjacent to the opening for indication, and the belt has an inside defining a smooth surface or a plurality of teeth portions to engaged with the transmission roller and the indication roller.

12. The indication structure as claimed in claim 11, wherein the transmission roller comprises a groove arranged on a curved surface thereof for the corresponding smooth surface of the belt matching within the groove of the transmission roller.

13. The indication structure as claimed in claim 11, wherein the indication roller comprises a groove arranged on a curved surface thereof for the corresponding smooth surface of the belt matching within the groove of the indication roller.

14. The indication structure as claimed in claim 11, wherein the transmission roller comprises a plurality of teeth portions arranged on a curved surface thereof for the corresponding teeth portions of the belt engaging with the teeth portions of the transmission roller.

15. The indication structure as claimed in claim 11, wherein the indication roller comprises a plurality of teeth portions arranged on a curved surface thereof for the corresponding teeth portions of the belt engaging with the teeth portions of the indication.

16. The indication structure as claimed in claim 10, wherein the transmission roller further comprises a protrusion portion arranged on a non-curved surface thereof for contacting with the support element.

17. The indication structure as claimed in claim 10, further comprising a transparent element mounted in the at least one opening.

18. The indication structure as claimed in claim 17, wherein the transparent element is a piece of optical transparent plastic or optical glass.

* * * * *